US007199314B2

(12) United States Patent
Huang et al.

(10) Patent No.: US 7,199,314 B2
(45) Date of Patent: Apr. 3, 2007

(54) JOYSTICK AND SWITCH

(75) Inventors: Chiao-Pu Huang, Kaohsiung (TW); Kao-Chang Chen, Kaohsiung (TW); Cheng-Huan Chen, Kaohsiung (TW)

(73) Assignee: CTS Corporation, Elkhart, IN (US)

( * ) Notice: Subject to any disclaimer, the term of this patent is extended or adjusted under 35 U.S.C. 154(b) by 21 days.

(21) Appl. No.: 11/271,590

(22) Filed: Nov. 10, 2005

(65) Prior Publication Data

US 2006/0279544 A1 Dec. 14, 2006

(51) Int. Cl.
*H01H 9/00* (2006.01)

(52) U.S. Cl. ..... 200/6 A; 200/6 R; 345/161; 345/168; 338/128; 338/160

(58) Field of Classification Search ..... 200/6 A, 200/6 R; 338/128–131, 160–161; 345/161–168
See application file for complete search history.

(56) References Cited

U.S. PATENT DOCUMENTS

| | | | |
|---|---|---|---|
| 3,394,611 | A | 7/1968 | Beurrier |
| 4,325,050 | A | 4/1982 | Suszynski |
| 4,375,631 | A | 3/1983 | Goldberg |
| 4,490,710 | A | 12/1984 | Kopsho, Jr. |
| 4,559,420 | A | 12/1985 | Yamada |
| 4,587,510 | A | 5/1986 | Kim |
| 4,620,176 | A | 10/1986 | Hayes |
| 5,229,742 | A | 7/1993 | Miyamoto |
| 5,473,325 | A | 12/1995 | McAlindon |
| 5,823,057 | A | 10/1998 | Hsien |
| 6,059,660 | A | 5/2000 | Takada |
| 6,078,247 | A | 6/2000 | Shimomura |
| 6,307,486 | B1 | 10/2001 | Takeda et al. |
| 6,353,430 | B2 | 3/2002 | Cheng et al. |
| 6,538,639 | B1 | 3/2003 | Takahashi |
| 6,580,418 | B1 | 6/2003 | Grome et al. |
| 6,654,005 | B2 | 11/2003 | Wang |

FOREIGN PATENT DOCUMENTS

DE 41 23 503 C2 4/1995

*Primary Examiner*—K. Lee
(74) *Attorney, Agent, or Firm*—Mark P. Bourgeois

(57) ABSTRACT

A joystick includes a base and a cover mounted over the base. A stick has a first end that extends from the cover and a second end. An active yoke is mounted above the base and is coupled to second end of the stick. The active yoke has a first and second end. The active yoke is adapted to be moved by the stick. A passive yoke is mounted over the active yoke and has a third and fourth end. The passive yoke is adapted to be moved by the stick. A first contactor is mounted to the first end and a second contactor is mounted to the third end. A first resistor is positioned between the first contactor and the cover and a second resistor is positioned between the second contactor and the cover. The resistors are adapted to generate an electrical signal that is indicative of a position of the stick. A switch is positioned in the base below the active yoke. The switch is activated when the stick is sufficiently depressed so as to cause the active yoke to contact the switch.

17 Claims, 11 Drawing Sheets

JOYSTICK AND SWITCH

BACKGROUND

1. Field of the Invention

This invention generally relates to human interface devices (HID) or control devices, like a joystick or pointing stick for controlling the positioning, movement and operation of a responsive electrical device such a cursor on a computer display screen. Specifically, there is a joystick with a switch that can both direct a cursor on a screen and select items on the screen.

2. Description of the Related Art

Various devices are well known for controlling cursor movement over a computer display screen of a computer and for signaling a choice of computer command identified by the position of the cursor on the display screen menu. The most commonly known devices are known as a "mouse" that has a ball on its underside rolled over a horizontal surface, with the x- and y-axis components of movement being sensed and transmitted through a connecting cable to a serial input port of the computer. The signal to the computer is varied by the amount and direction of movement of the mouse ball, and causes the cursor on the display screen to have a corresponding movement. One or two "mouse" or "click" buttons, located on the top of the mouse at the forward end, permit the computer operator to enter a selection or other command to the computer (the command typically being shown by the position of the cursor on a displayed menu) upon pressing one or the other or both buttons, depending upon the software associated with the device. Such a device, requires a flat, horizontal surface.

Another well known electrical controlling and signaling mechanism is a "joystick." The joystick is typically an elongated stick that extends upwardly from a base connected to the computer console by means of a cable. The joystick is operated by tilting the upstanding stick in various directions to cause the cursor or other display element to move in a direction and usually at a speed corresponding to the direction and pressure exerted on the stick by the computer operator It is important for a joystick to have a small size and as few parts to the design as possible, to reduce the complexity and cost of manufacturing. A joystick should also have the capability to translate the desired range of mechanical motion into an appropriate electrical signal.

An ongoing need exists for an improved joystick with a switch.

SUMMARY

It is a feature of the invention to provide a joystick and switch.

A further feature of the invention to provide a joystick that includes a base and a cover mounted over the base. A stick has a first end that extends from the cover and a second end. An active yoke is mounted above the base and is coupled to the second end. The active yoke has a first and second end. The active yoke is adapted to be moved by the stick. A passive yoke is mounted over the active yoke and has a third and fourth end. The passive yoke is adapted to be moved by the stick. A first wiper is mounted to the first end and a second wiper is mounted to the third end. A first resistor is positioned between the first wiper and the cover and a second resistor is positioned between the second wiper and the cover. The resistors are adapted to generate an electrical signal that is indicative of a position of the stick when a voltage is applied to the resistors. Several terminals are mounted to the base. A first portion of the terminals are electrically connected to the resistors. A switch is positioned in the base below the active yoke. The switch is activated when the stick is sufficiently depressed so as to cause the active yoke to contact the switch and to close the switch. The switch is electrically connected to a second portion of the terminals. A spring is mounted between the base and the active yoke. The spring biases the active yoke, the passive yoke and the stick away from the base.

BRIEF DESCRIPTION OF THE DRAWINGS

These and other features of the invention can best be understood by the following description of the accompanying drawings as follows.

Figure 1:
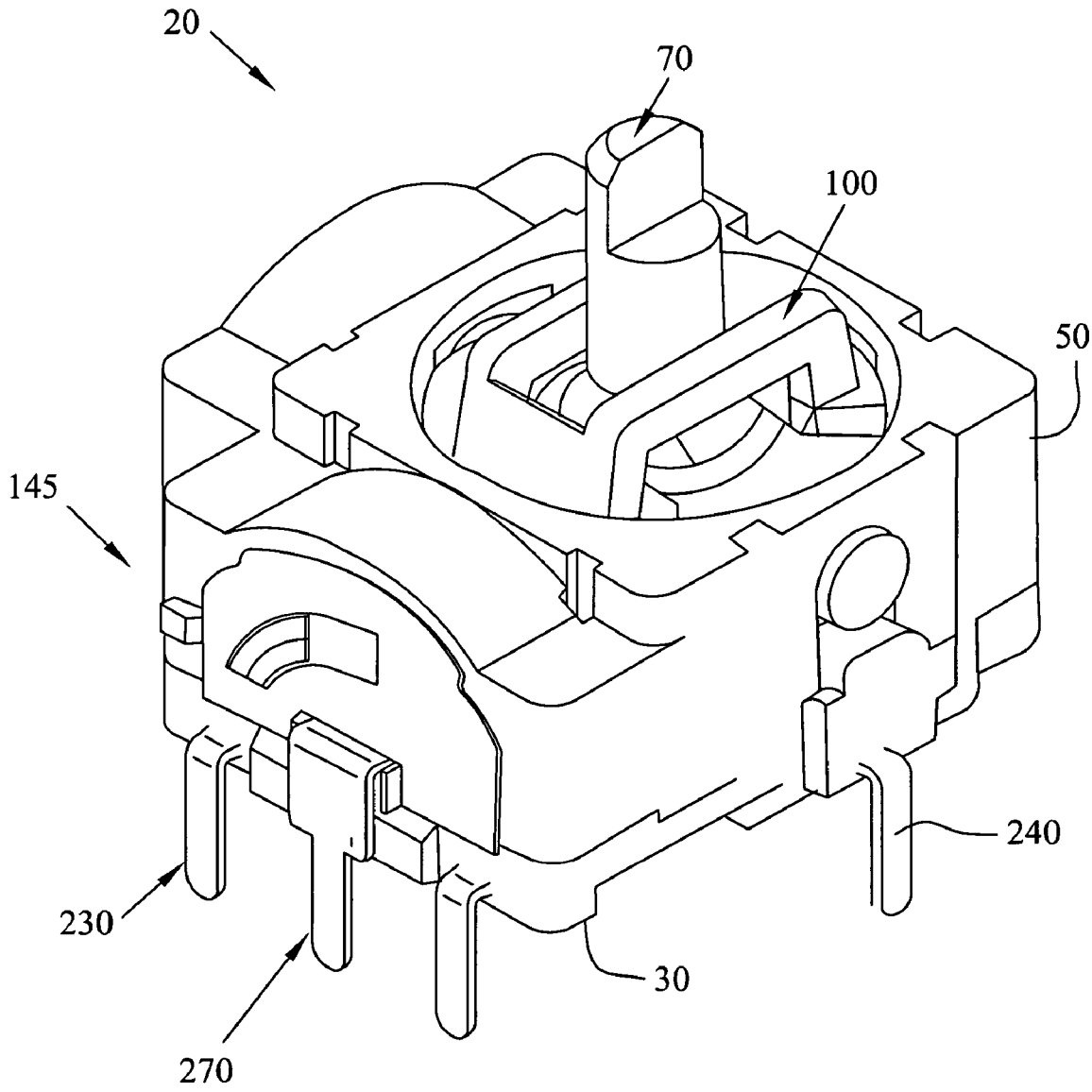
FIG. 1 is a perspective assembled view of a joystick and switch of the present invention.
Figure 2:
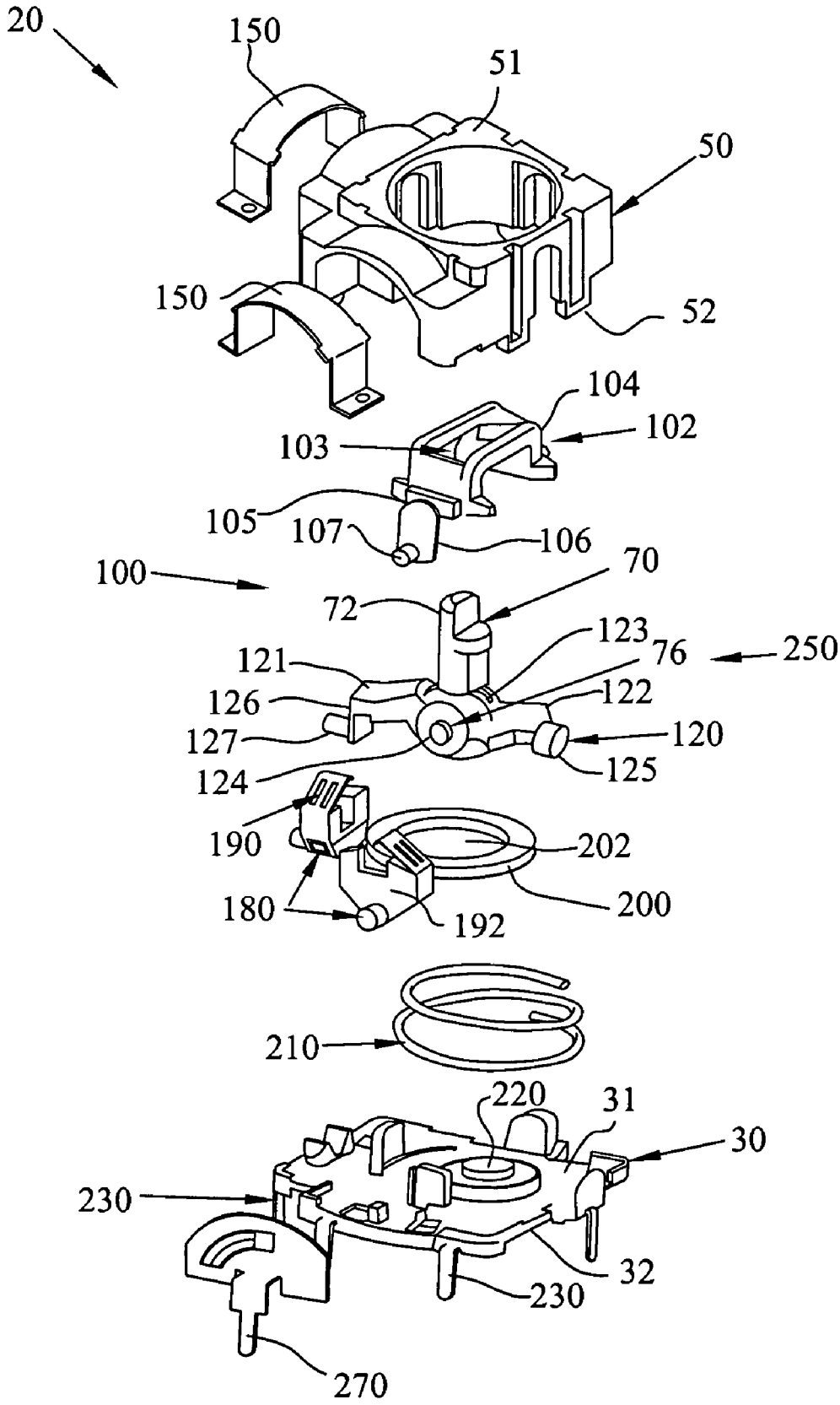
FIG. 2 is an exploded perspective view of a FIG. 1.
Figure 3:
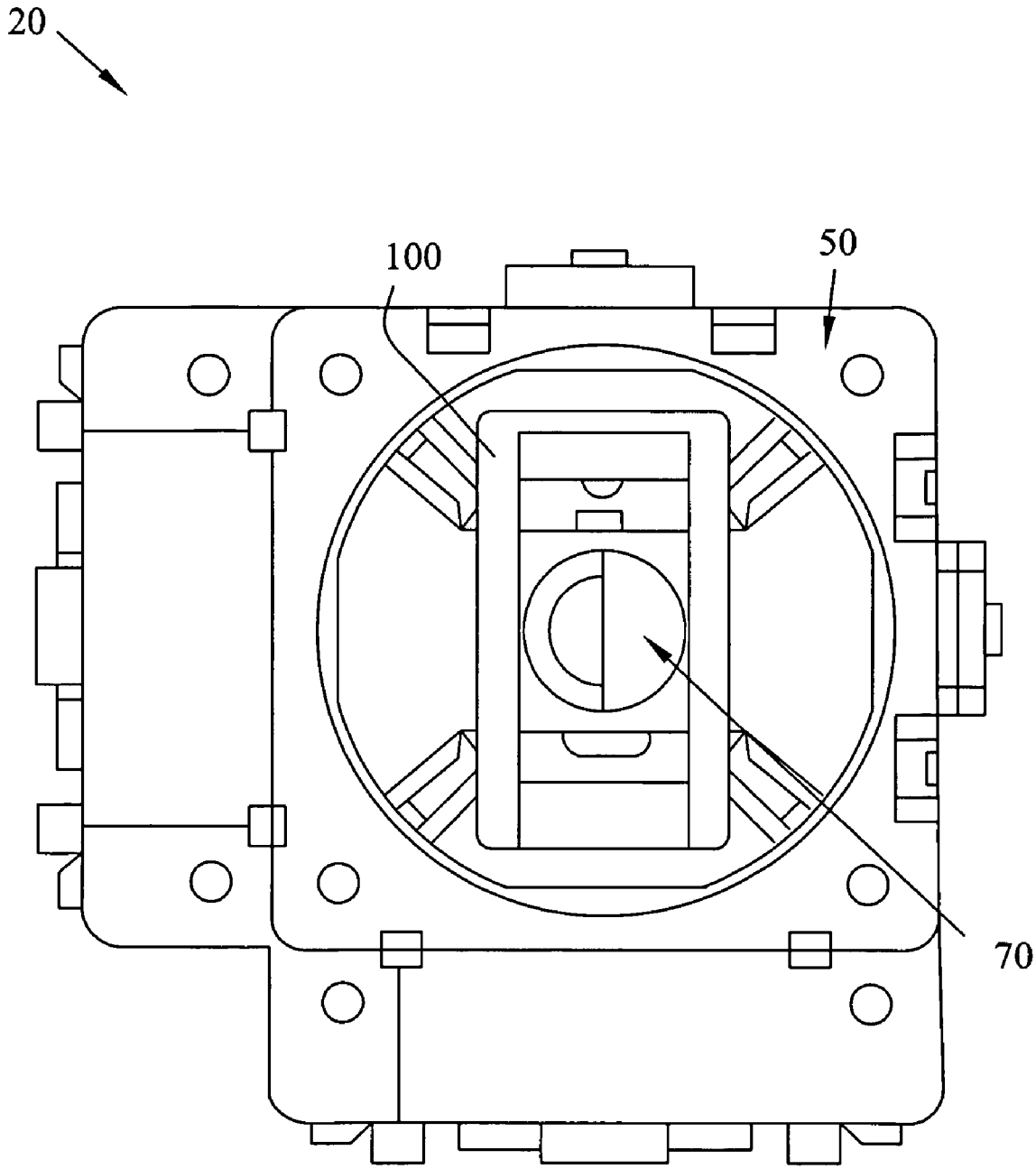
FIG. 3 is a top view of FIG. 1 with the cover removed.
Figure 4:
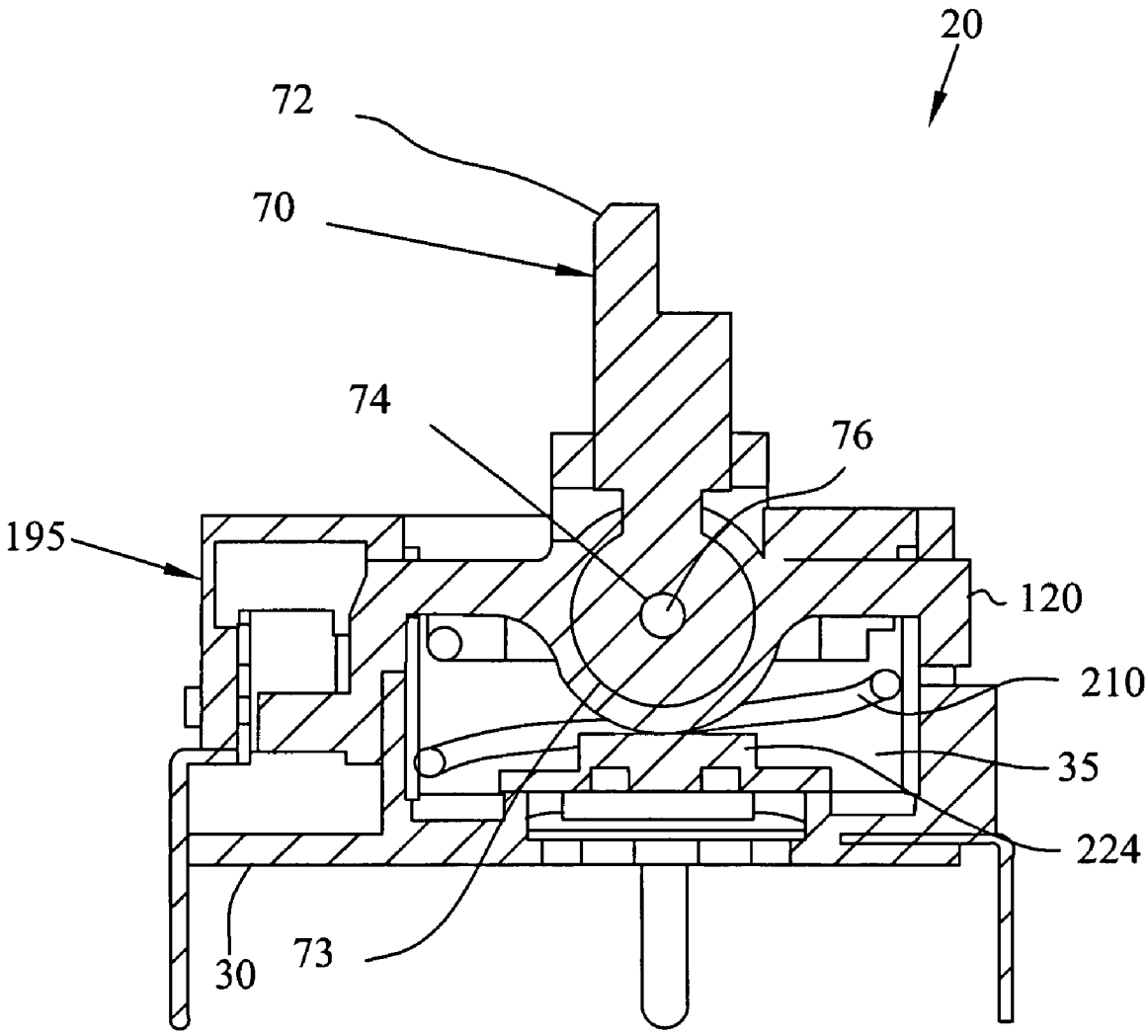
FIG. 4 is a cross-sectional view of FIG. 1.
Figure 5:
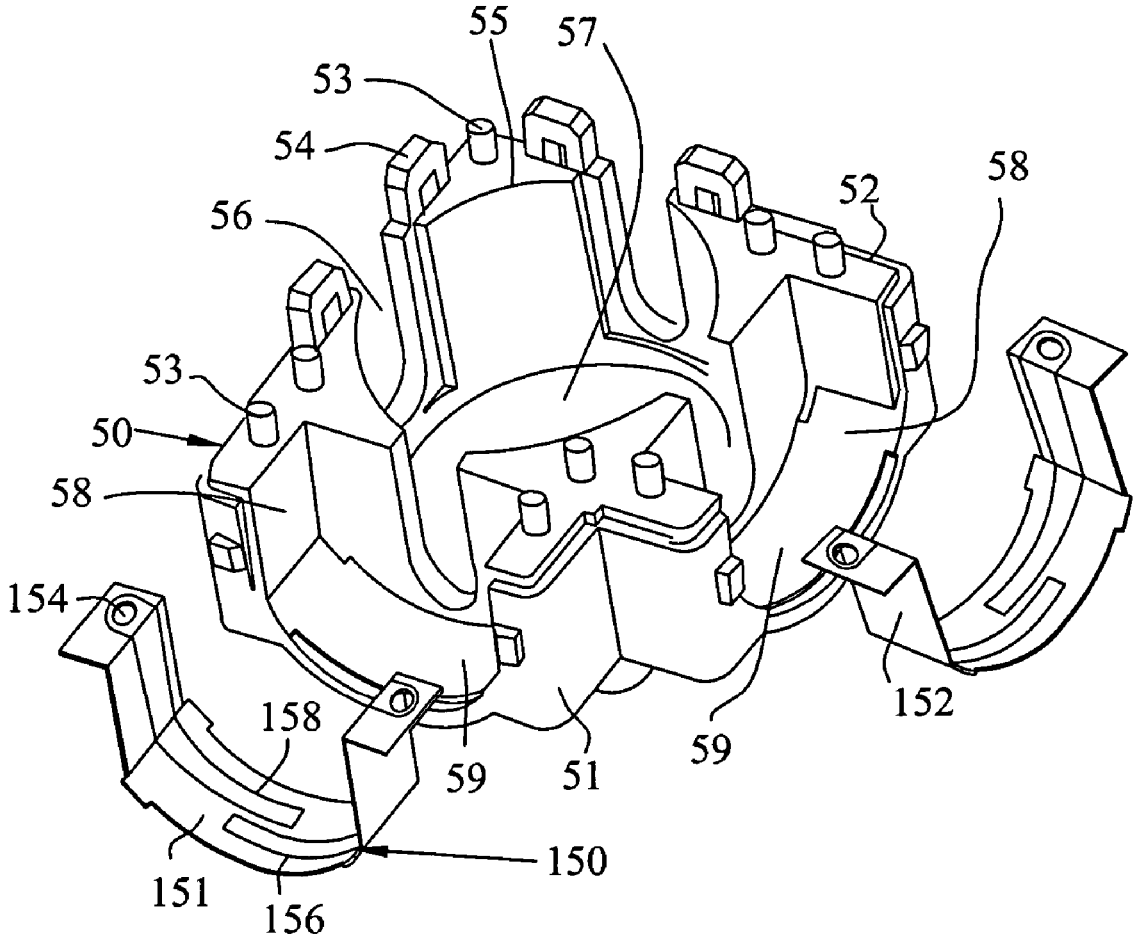
FIG. 5 is a perspective view of the cover and flexible films.
Figure 6:
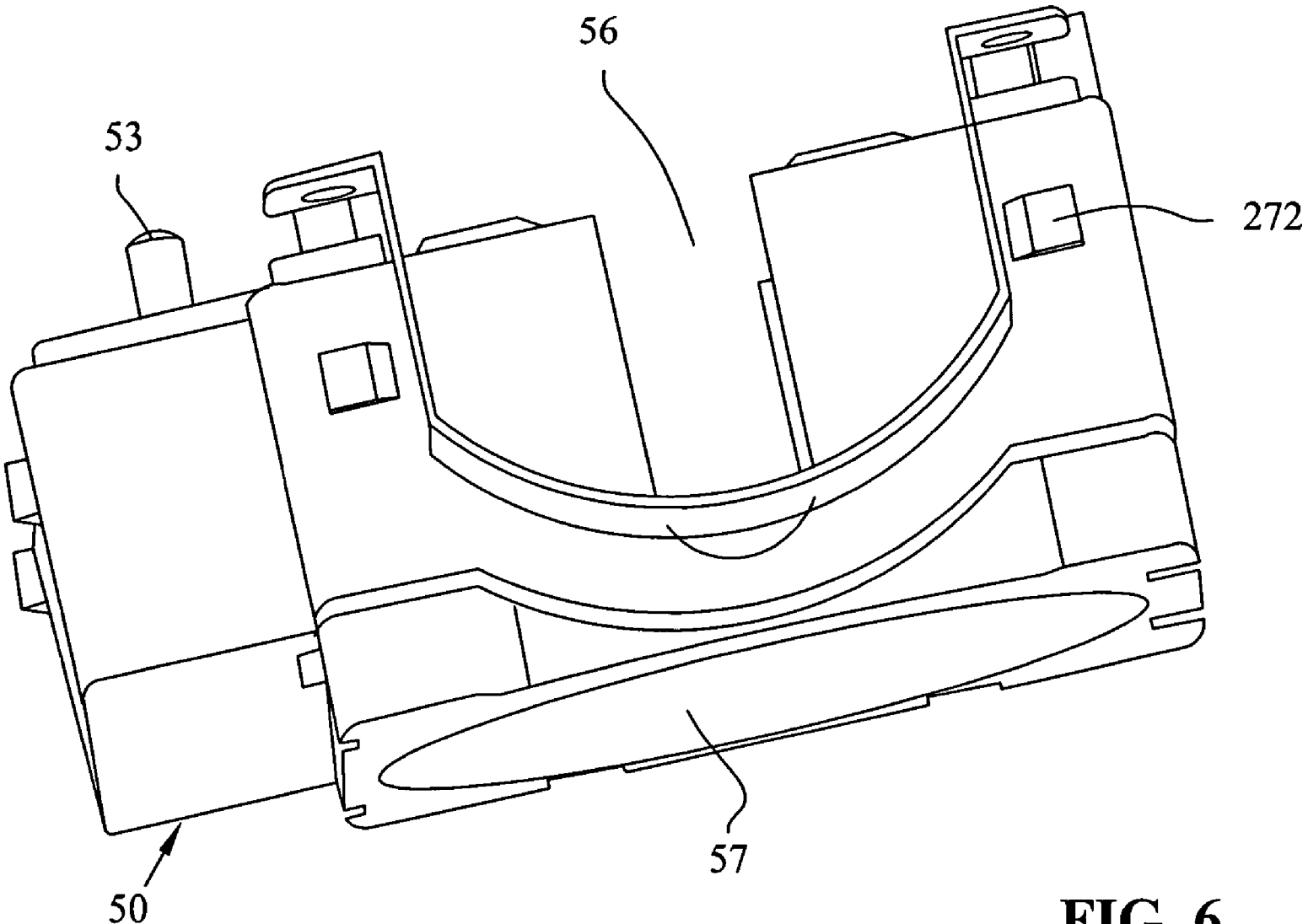
FIG. 6 is a side view of the cover and element.
Figure 7:
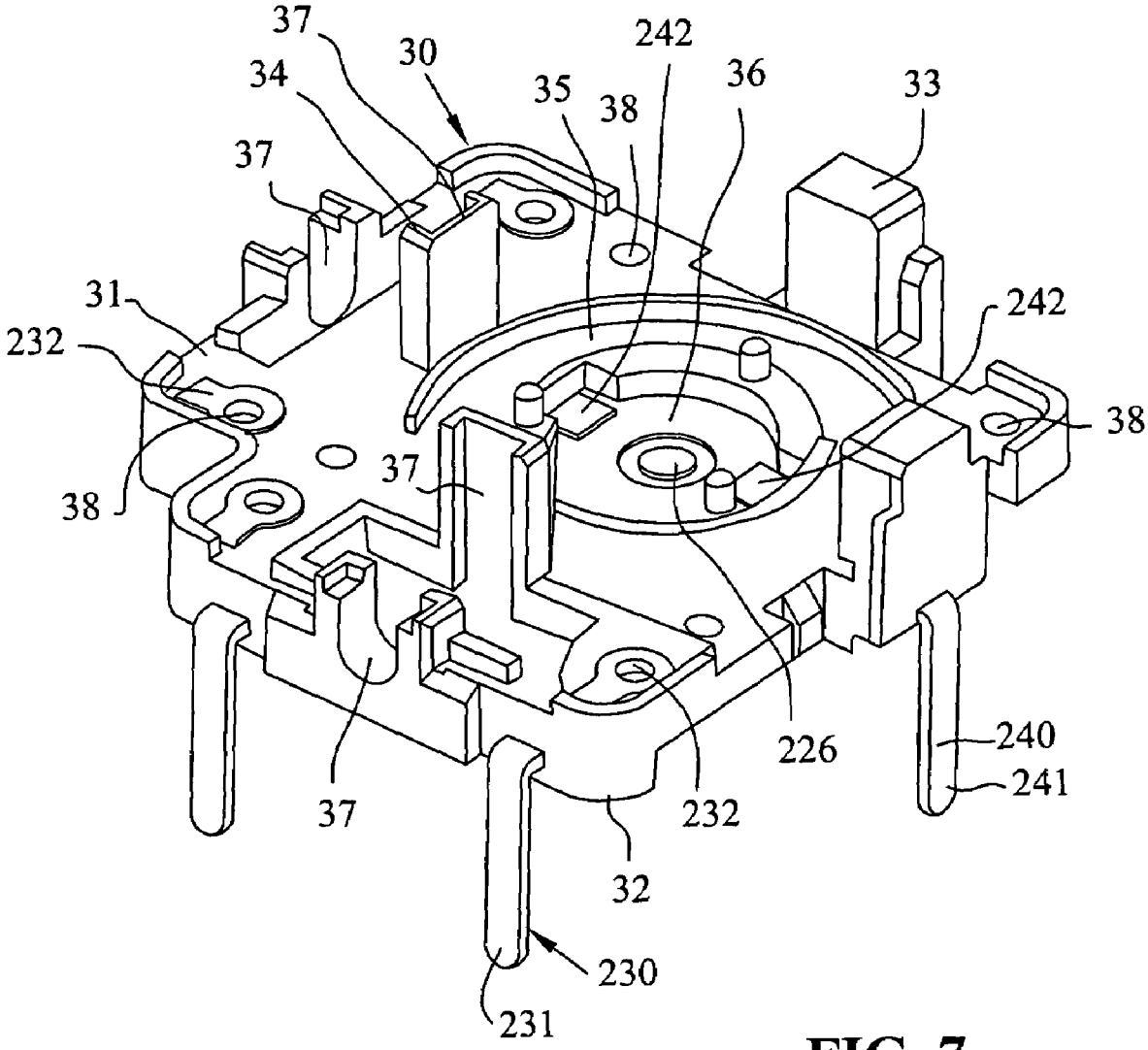
FIG. 7 is a perspective view of the base and terminal.
Figure 8:
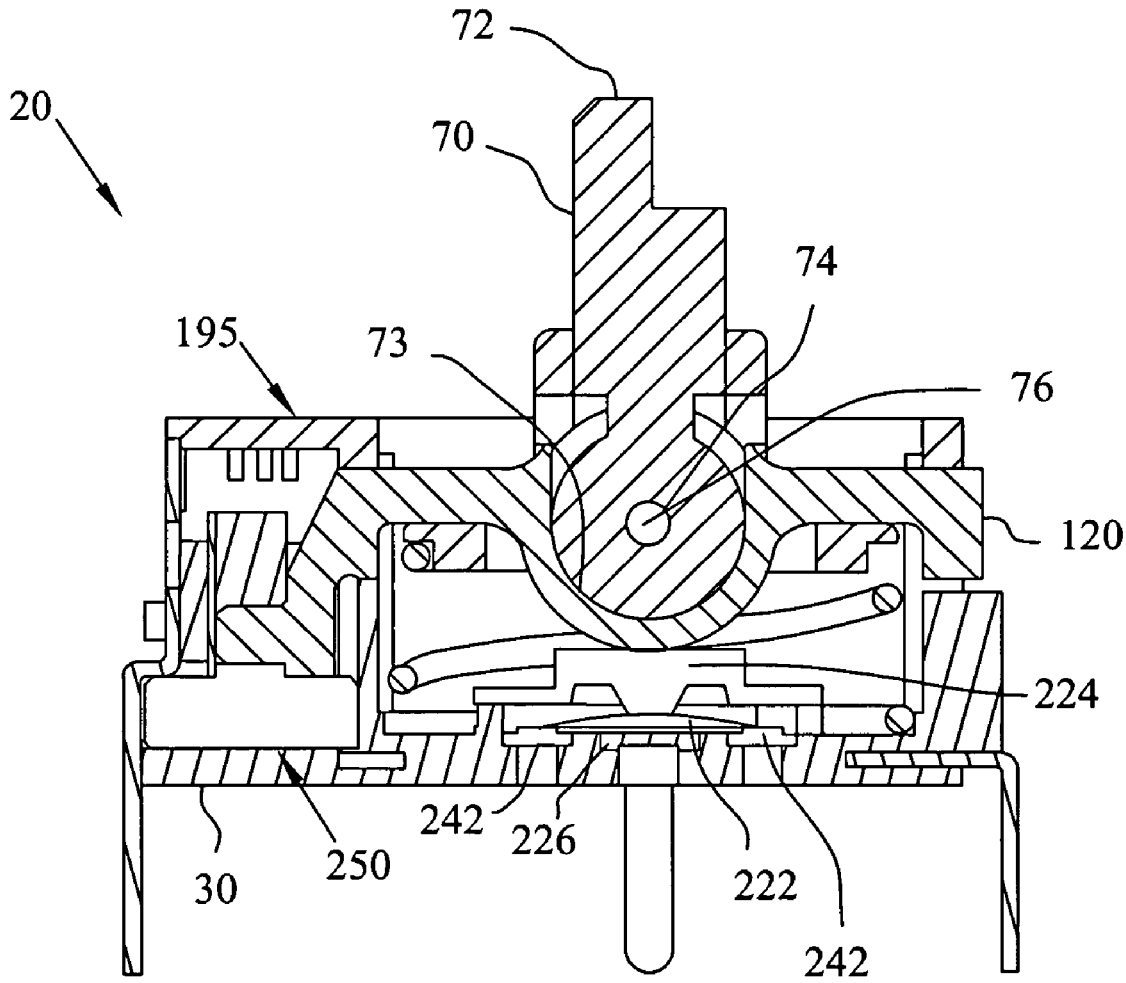
FIG. 8 is another cross-sectional view of FIG. 1.
Figure 9:
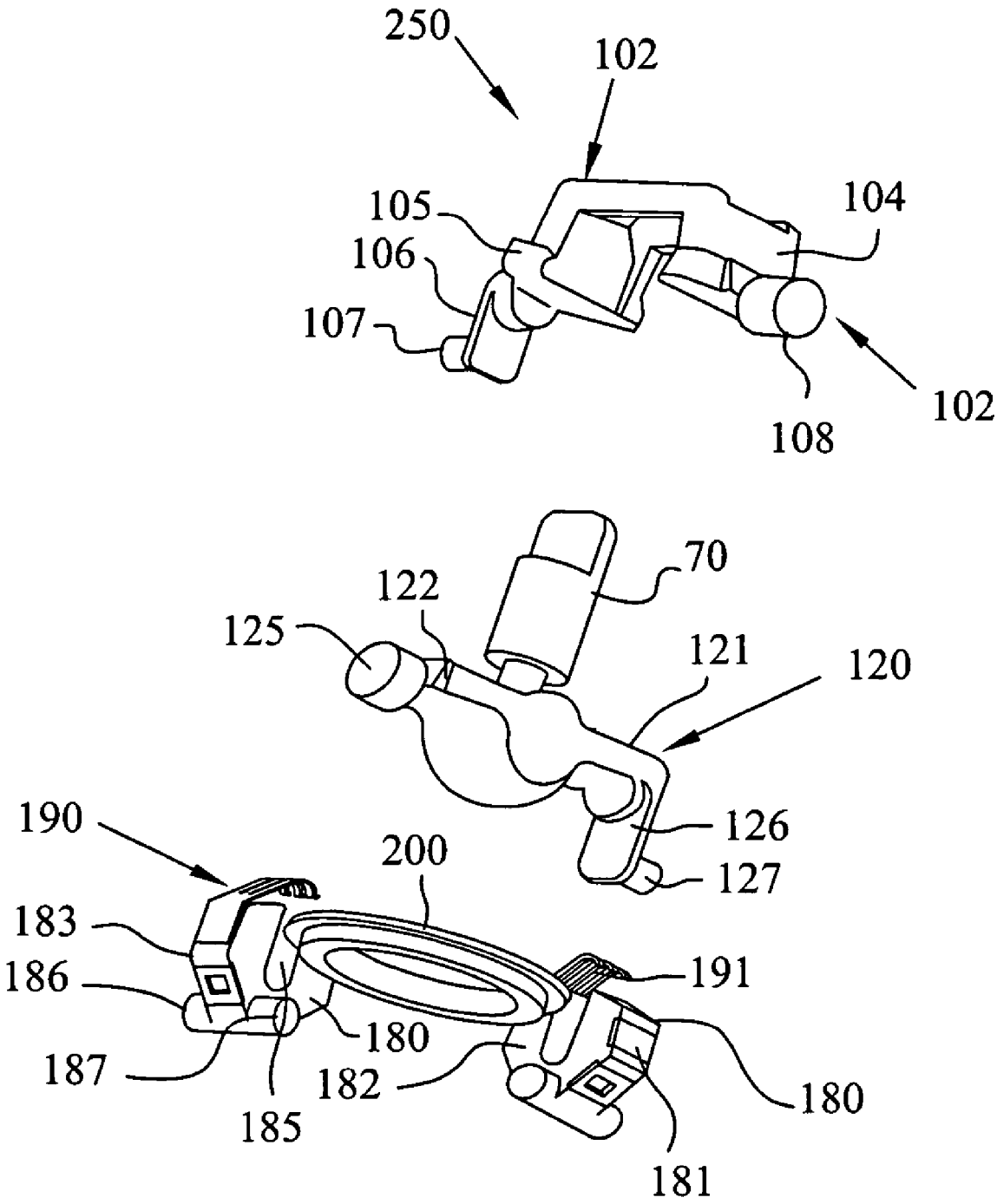
FIG. 9 is a perspective view of the yokes and rotors.
Figure 10:
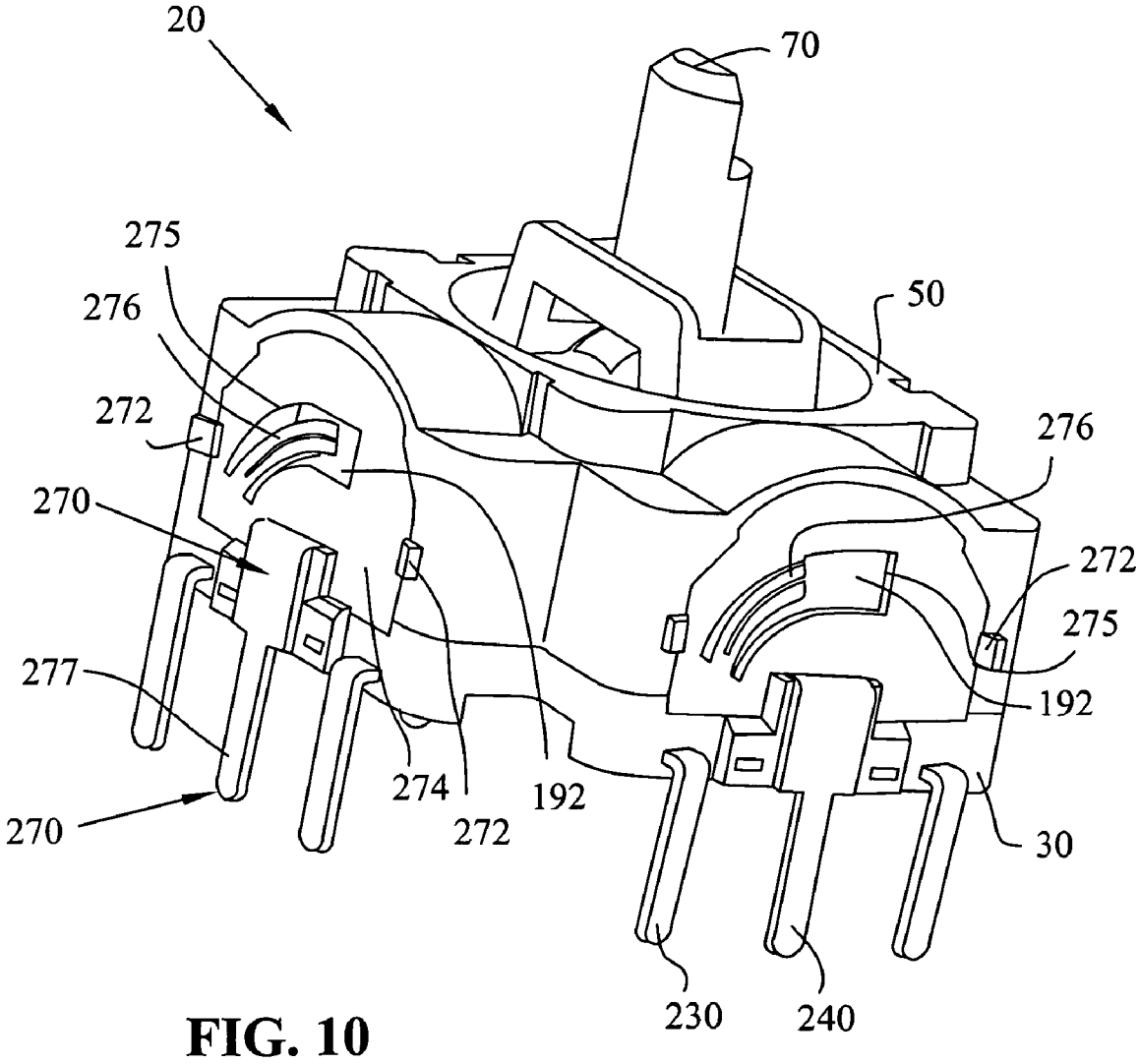
FIG. 10 is a perspective view of the joystick and central terminals.
Figure 11:
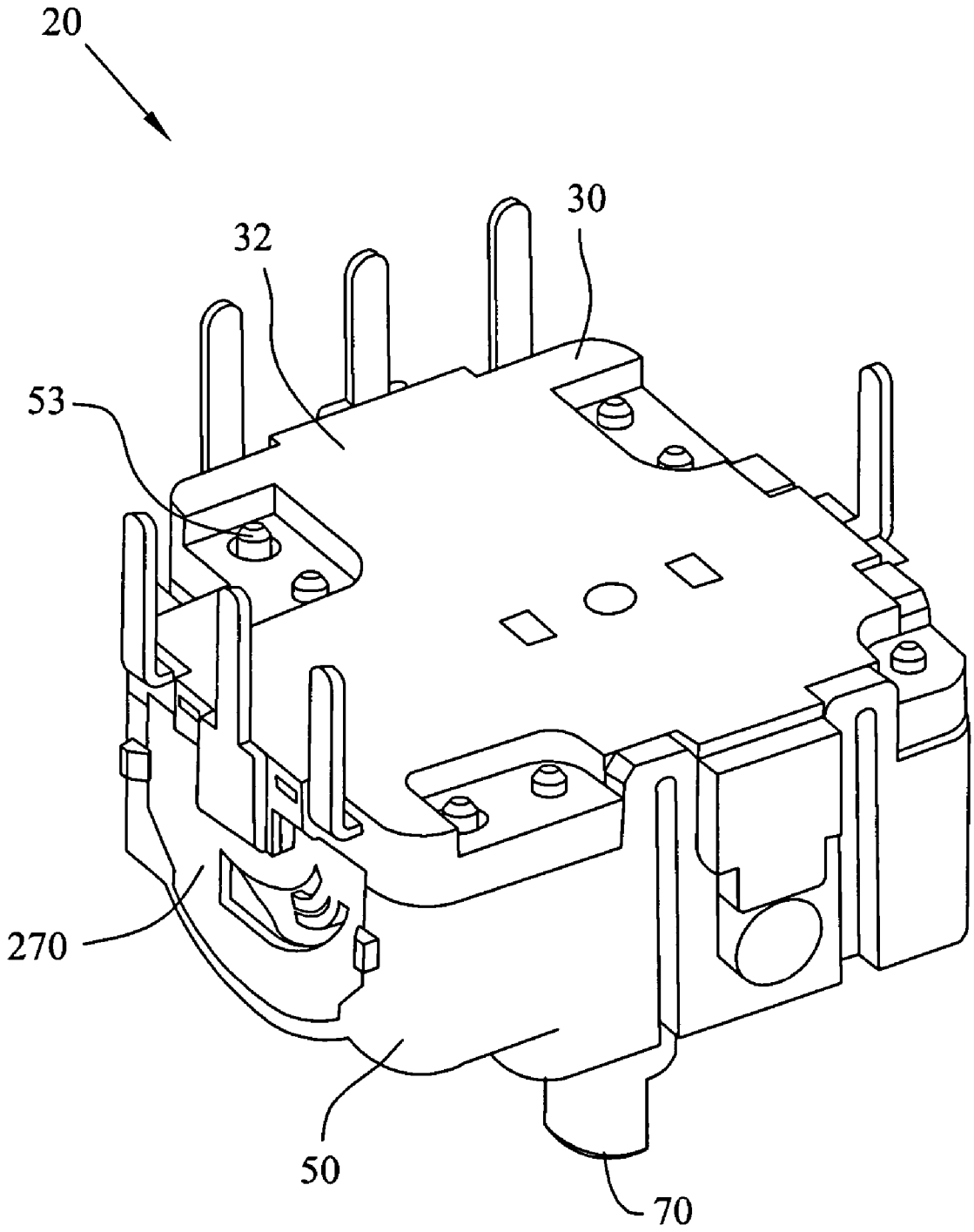
FIG. 11 is a bottom perspective of the assembled joystick.

It is noted that the drawings of the invention are not to scale.

DETAILED DESCRIPTION

Referring to FIGS. 1–11, there is a joystick and switch assembly 20 that can, for example, be used to control the movement of a cursor on a computer screen (not shown). The joystick assembly 20 is made up of a base 30, cover 50, stick 70, gimbal assembly 100 and flexible films or elements 150 and switch assembly 200.

Cover 50 has a top 51 and bottom 52. Cover 50 has several pins 53 and projections 54 extending from bottom 52. Cover 50 is mounted over base 30. An aperture 57 allows stick 70 to pass through cover 50. Cover 50 has walls 55. Several slots 56 are formed in walls 55. A pair of semi-circular cavities 58 are located in cover 50. Cavities 58 have an inner surface 59. Flexible films 150 are mounted in cavities 58 on surfaces 59.

Base 30 has a top 31 and bottom 32. Posts 33 and 34 extend upwardly from top 31. A recess 36 is located in the center of base 30. A U-shaped slot 37 is located in post 34. Several holes 38 pass through base 30. Base 30 and cover 50 can be formed from injection molded plastic. When cover 50 is mated with base 30, pins 53 extend into and beyond holes 38. Pins 38 are ultrasonically welded to retain base 30 to cover 50.

Stick 70 has ends 72 and 73. End 73 has an aperture 74. A rivet 76 is mounted through aperture 74 and retains stick 70 to active yoke 120.

Gimbal assembly 100 includes a passive yoke 102 mounted over an active yoke 120. Passive yoke 102 has a slot 103 and ends 104 and 105. An arm 106 extends from end 105. A post 107 extends from arm 106. Another post 108 extends from end 104. Active yoke 120 has ends 121 and 122 and a slot 123. An arm 126 extends from end 105. A post 127 extends from arm 126. Another post 125 extends from end 122. Stick 70 extends through slot 103.

A pair of rotors 180 are adapted to be moved by posts 107 and 127. Rotor 180 has an outer peripheral surface 181, sides 182, 183, a slot 185 and pins 186 and 187. A metal contactor 190 is mounted to surface 181. Contactor 190 has fingers 191 and a side portion 192 that extends onto a portion of rotor side 183. Fingers 191 and side portion 192 are in electrical contact.

A pair of elements or flexible films 150 are mounted in cavity 58. The flexible film is preferably a Kapton film. Flexible film 150 has sides 151, 152 and holes 154. Holes 154 are mounted over pins 53. Flexible film 150 has a resistor track 156 and a conductor track 158 mounted on side 151. The resistors and conductors are conventional polymer conductors and resistors. Contactor fingers 191 slide along and are in electrical contact with resistor track 156 and conductor track 158. Contactor 190, resistor track 156 and conductor track 158 form a potentiometer 195 after assembly.

Holdplate 200 has a hole 202. Holdplate 200 resides under active yoke 120. A coil spring 210 is located in a recess 35. Spring 210 biases holdplate 200 toward yoke 120 away from base 30.

Switch 220 has a metal dome 222 and an actuator 224. Switch 220 is mounted in cavity 36. The switch is activated when stick 70 is depressed sufficiently so as to cause active yoke 120 to contact actuator 224 and cause dome 222 to collapse and to contact switch contact 226 thus completing an electrical circuit between switch terminal ends 242 and contact 226.

Terminals 230 are insert molded into base 30. Terminals 230 have an end 231 and a resistor contact end 232. Resistor contact end 232 is in electrically connected to either resistor track 156 or conductor track 158 by either soldering or crimping. Terminal end 231 would be inserted into another printed circuit board (not shown) where it would be electrically connected to an electrical device or circuit such as a computer or controller.

Switch terminals 240 are also insert molded into base 30. Terminals 240 have an end 241 and an end 242. Ends 242 are in contact with metal dome 222.

A lever assembly 250 includes rotors 180 and yokes 102 and 120. Rotor 180 is mounted with pins 186 and 187 supported for rotation in slots 37. Posts 107 and 127 extend into slots 185. Posts 107 and 127 are offset from the axis of rotation of yokes 102 and 120 by arms 106 and 126. The offset of the axes causes a lever or multiplier effect to be applied to the rotors. The lever ratio is about 1 to 1.37. For example, if the yoke rotates 10 degrees. The rotor and contactor will rotate 13.7 degrees. This causes an increase of 37 percent in the rotor distance traveled along flexible film 150.

Ends 108 and 125 are supported for rotation in slot 56 and rest on top of posts 33.

Poteniometer 195 allows the sensing of the rotational position of each yoke 102 and 120. A voltage is applied between two of the terminals 230 that are connected to resistor track 156 and conductor track 158. As yokes 102 and 120 move, contactor fingers 191 move on resistor tracks 156 and conductor tracks 158 and the voltage between the terminals 130 changes.

Center terminals 270 are mounted in base 30 and cover 50. Terminals 270 are formed from an electrically conductive metal. Terminals 270 are retained to cover 50 by a heat staked bump 272. Terminals 270 have a body 274, a slot 275, a pair of wipers 276 and an end 277. End 277 can be mounted in a printed circuit board. Wipers 276 are angled inwardly such that they electrically contact contactor side portion 192 forming and electrical path from contactor 190 to end 277. Wipers 276 provide an output tap from contactor 190. The wipers 276 rub against side portion 192 as rotors 180 are rotated.

The resulting potentiometer output voltage between two of terminals 230 that are connected to resistor track 156 and conductor track 158 is measured or read on terminal 270 and is proportional to the position of the yoke. Terminal 270 is the potentiometer 195 output signal. Because stick 70 is attached to the yoke, the voltage is also proportional to the position of the stick 70.

The stick 70 is shown in a centered or centering position in FIG. 1. That is, a position that has stick 70 in a vertical position that allows the shaft to be moved an equal and maximum distance in all directions perpendicular to the shaft. The spring 210 forces holdplate 200 against yokes 102 and 120. This forces the stick 70 into a vertical centered position. When stick 70 is moved off center, holdplate 70 is pressed downwardly. Since holdplate 200 is biased by spring 210, the user pressing on stick 70 feels a feedback force. Also, once the user releases stick 70, spring 210 urges the stick back into a centering position.

One of ordinary skill in the art of designing joysticks will realize many advantages from using the preferred embodiment. In particular, joystick and switch assembly 20 has a low height or profile due to the mounting of the flexible film 150 in the cover 50. The use of lever mechanism 250 allows for a longer travel distance of contactor 190 on film 150 and for increased resolution and linearity of the output signal. In other words, the longer contractor travel distance results in a more accurate electrical signal that represents the position of stick 70.

The use of flexible film 150 mounted to the cover prevents excessive force from being applied to contactor 190 during depression of stick 70. Further, the integration of switch 220 within the base 30 leads to an overall compact package size.

Although the invention has been taught with specific reference to these embodiments, someone skilled in the art will recognize that many other changes can be made in form and detail without departing from the spirit and the scope of the invention. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A joystick, comprising:

a) a base;

b) a cover mounted over the base;

c) a stick having a first end extending from the cover and a second end;

d) an active yoke mounted above the base and coupled to the second end, the active yoke having a first and second end, the active yoke adapted to be moved by the stick;

e) a passive yoke mounted over the active yoke and having a third and fourth end, the passive yoke adapted to be moved by the stick;

f) a first contactor mounted to the first end;

g) a second contactor mounted to the third end;

h) a first resistor positioned between the first contactor and the cover;

i) a second resistor positioned between the second contactor and the cover; the resistors adapted to generate an electrical signal indicative of a position of the stick when a voltage is applied to the resistors;

j) a plurality of terminals mounted to the base, a first portion of the terminals electrically connected to the resistors; and k) a switch, positioned in the base below the active yoke, the switch activated when the stick is sufficiently depressed so as to cause the active yoke to contact the switch and to close the switch, the switch electrically connected to a second portion of the terminals; and l) a spring mounted between the base and the active yoke, the spring biasing the active yoke, the passive yoke and the stick away from the base.

2. The joystick of claim 1, wherein the resistors are mounted to a flexible film.

3. The joystick of claim 2, wherein the flexible film is mounted in a cavity in the cover.

4. The joystick of claim 2, wherein the cover has a plurality of pins that retain the flexible film.

5. The joystick of claim 1, wherein a first rotor is adapted to be moved by the first end and a second rotor is adapted to be moved by the third end.

6. The joystick of claim 5, wherein the first and second rotors each have a pair of rods extending therefrom, the rods being engaged with the base.

7. The joystick of claim 6, wherein the rotors and the yokes, in combination, when moved act as a lever to increase the distance traveled by the contactors.

8. The joystick of claim 1, wherein at least one central terminal is mounted to the base, the central terminal in electrical contact with one of the rotors.

9. A joystick, comprising:

a) a base;

b) a cover mounted over the base;

c) a stick having a first end extending from the cover and a second end;

d) an active yoke mounted above the base and coupled to the second end, the active yoke having a first and second end, the active yoke adapted to be moved by the stick;

e) a passive yoke mounted over the active yoke and having a third and fourth end, the passive yoke adapted to be moved by the stick;

f) a contactor mounted to the first end;

g) a film positioned between the contactor and the cover, the film having a resistor track and a conductor track;

h) a first terminal mounted to the base and electrically connected to the resistor track;

i) a second terminal mounted to the base and electrically connected to the conductor track;

j) a third terminal mounted to the cover and electrically connected to the contactor;

k) the third terminal adapted to provide an electrical signal indicative of a position of the stick when a voltage is applied between the first and second terminals; and l) a spring mounted between the base and the active yoke, the spring biasing the active yoke, the passive yoke and the stick away from the base.

10. The joystick of claim 9, wherein the film is mounted in a cavity in the cover.

11. The joystick of claim 9, wherein another contactor is mounted to the third end.

12. The joystick of claim 9, wherein a rotor is mounted to the first end, the contactor mounted to the rotor.

13. The joystick of claim 12, wherein the rotor has a pair of rods extending therefrom, the rods being engaged with the base.

14. The joystick of claim 13, wherein the rotor and the yokes, in combination, when moved act as a lever to increase the distance traveled by the contactor.

15. The joystick of claim 9, further comprising, a switch, positioned in the base below the active yoke, the switch activated when the stick is sufficiently depressed so as to cause the active yoke to contact the switch and to close the switch, the switch electrically connected to a fourth terminal.

16. The joystick of claim 15, further comprising, a switch, positioned in the base below the active yoke, the switch activated when the stick is sufficiently depressed so as to cause the active yoke to contact the switch and to close the switch.

17. A joystick, comprising:

a) a base;

b) a cover mounted over the base;

c) a stick having a first end extending from the cover and a second end;

d) an active yoke mounted above the base and coupled to the second end, the active yoke having a first and second end, the active yoke adapted to be moved by the stick;

e) a first arm mounted to the first end;

f) a passive yoke mounted over the active yoke and having a third and fourth end, the passive yoke adapted to be moved by the stick;

g) a second arm mounted to the third end;

h) a first rotor mounted to the first arm, the first rotor having a first contactor mounted thereto;

i) a second rotor mounted to the second arm, the second rotor having a second contactor mounted thereto;

j) a first resistor track positioned between the first contactor and the cover; and k) a second resistor track positioned between the second contactor and the cover; the resistor tracks adapted to generate an electrical signal indicative of a position of the stick when a voltage is applied to the resistor tracks.

* * * * *